US010188180B2

(12) United States Patent
Yamagishi et al.

(10) Patent No.: US 10,188,180 B2
(45) Date of Patent: Jan. 29, 2019

(54) SLIDER FOR SLIDE FASTENER

(71) Applicant: YKK Corporation, Tokyo (JP)

(72) Inventors: Koji Yamagishi, Toyama (JP); Natsuko Saitsu, Toyama (JP); Shigeyoshi Takazawa, Toyama (JP)

(73) Assignee: YKK Corporation (JP)

( * ) Notice: Subject to any disclaimer, the term of this patent is extended or adjusted under 35 U.S.C. 154(b) by 0 days.

(21) Appl. No.: 15/320,443

(22) PCT Filed: Jun. 20, 2014

(86) PCT No.: PCT/JP2014/066461

§ 371 (c)(1),
(2) Date: Dec. 20, 2016

(87) PCT Pub. No.: WO2015/194044

PCT Pub. Date: Dec. 23, 2015

(65) Prior Publication Data

US 2017/0156452 A1 Jun. 8, 2017

(51) Int. Cl.
*A44B 19/26* (2006.01)

(52) U.S. Cl.
CPC ..... *A44B 19/262* (2013.01); *A44B 19/26* (2013.01); *Y10T 24/2586* (2015.01)

(58) Field of Classification Search
CPC ... A44B 19/262; A44B 19/26; Y10T 24/2586; B29L 2005/00
See application file for complete search history.

(56) References Cited

U.S. PATENT DOCUMENTS 2,145,118 A * 1/1939 Knoess ..... A44B 19/262 24/429
2,229,216 A * 1/1941 Marinsky ..... A44L 319/26 24/382

(Continued)

FOREIGN PATENT DOCUMENTS

JP 2000-279211 A 10/2000
JP 2004-344310 A 12/2004
JP 2009-056076 A 3/2009

OTHER PUBLICATIONS

International Search Report, PCT International Patent Application No. PCT/JP2014/066461, dated Sep. 16, 2014.

(Continued)

*Primary Examiner* — Robert Sandy
*Assistant Examiner* — Rowland Do
(74) *Attorney, Agent, or Firm* — Kilpatrick Townsend & Stockton LLP

(57) ABSTRACT

There is provided a slide fastener slider. A slider body has an upper blade and a lower blade connected by a guide post at front end sides thereof, and a pull tab attached to a pull tab attachment portion formed on the upper blade. The pull tab attachment portion has a pair of right and left first members protruding from the upper surface of the upper blade, and a second member connecting the pair of the right and left first members. The first members have a base portion and a wall portion arranged to extend from the base portion toward at least one of front and rear sides thereof. The pull tab has a string-shaped member and the string-shaped member is attached to the pull tab attachment portion.

6 Claims, 15 Drawing Sheets

(56) References Cited

U.S. PATENT DOCUMENTS

| | | | | |
|---|---|---|---|---|
| 5,603,144 | A * | 2/1997 | Akashi | A44B 19/308 24/421 |
| 6,353,983 | B1 | 3/2002 | Oda et al. | |
| 2002/0133917 | A1* | 9/2002 | Chu | A44B 19/262 24/429 |
| 2004/0231115 | A1 | 11/2004 | Keyaki et al. | |
| 2009/0056086 | A1 | 3/2009 | Ujihara et al. | |
| 2009/0265899 | A1 | 10/2009 | Yang | |

OTHER PUBLICATIONS

Written Opinion, PCT International Patent Application No. PCT/JP2014/066461, dated Sep. 16, 2014.
International Preliminary Report on Patentability, PCT International Patent Application No. PCT/JP2014/066461, dated Dec. 29, 2016.

* cited by examiner

SLIDER FOR SLIDE FASTENER

This application is a national stage application of PCT/JP2014/066461, which is incorporated herein by reference.

TECHNICAL FIELD

The present invention relates to a slider for a slide fastener.

BACKGROUND ART

As conventional sliders for slide fasteners, a slider is known which includes a slider body and a pull tab attached to a pull tab attachment portion formed an upper blade of the slider body, wherein the pull tab attachment is formed in the shape of a gate along a width direction of the slider body (e.g., see Patent Document 1).

PRIOR ART DOCUMENT

Patent Document

Patent Document 1: Japanese Patent Application Publication No. 2009-056076A

SUMMARY OF INVENTION

Problems to be Solved by Invention

However, in such a slide fastener slider as described in Patent Document 1, when a pull tab having a string-shaped member is attached to the pull tab attachment portion, the string-shaped member of the pull tab is difficult to be inserted into the pull tab attachment portion, because the pull tab attachment portion has the shape of a gate. Therefore, it is difficult to attach the pull tab to the pull tab attachment portion. Also, because the pull tab attachment portion has the shape of a gate having a narrow width, the pull tab attachment portion has a low strength.

The present invention has been made keeping in mind the above problems, and an object thereof is to provide a slide for a fastener slider, in which a pull tab can be easily attached to a pull tab attachment portion and a strength of the pull tab attachment portion can be improved.

Means for Solving Problems

The above object of the present invention is achieved by the following configurations:

(1) A slide fastener slider including a slider body having an upper blade and a lower blade connected by a guide post at front end sides thereof, and a pull tab attached to a pull tab attachment portion formed on the upper blade, wherein the pull tab attachment portion has a pair of right and left first members protruding from the upper surface of the upper blade, and a second member connecting the pair of the right and left first members, wherein the first members have a base portion and a wall portion arranged to extend from the base portion toward at least one of front and rear sides thereof, and wherein the pull tab has a string-shaped member and the string-shaped member is attached to the pull tab attachment portion.

(2) The slide fastener slider according to (1), wherein the wall portions are arranged to extend from the base portion toward both of the front and rear sides.

(3) The slide fastener slider according to (1) or (2), wherein opposing side surfaces of the pair of the right and left first members are respectively formed as inclined surfaces, and wherein a space between upper end portions of the right and left inclined surfaces is set to be greater than a space between lower end portions of the right and left inclined surfaces.

(4) The slide fastener slider according to any one of (1) to (3), wherein the second member is arranged at a location, at which a width of the first members in a right and left direction is the largest.

(5) The slide fastener slider according to any one of (2) to (4), wherein an upper surface of the first members is formed so that a width of the first members in an upward and downward direction gradually decreases toward front and rear end sides thereof, and wherein the second member is arranged at a location, at which the width of the first members in the upward and downward direction is the largest.

(6) The slide fastener slider according to any one of (1) to (4), wherein a recess portion is formed in the second member.

Advantageous Effects of Invention

According to the present invention, the pull tab attachment portion has the pair of right and left first members protruding from the upper surface of the upper blade and the second member connecting the pair of the right and left first members, the first members have the base portion and the wall portion arranged to extend from the base portion toward at least one of front and rear sides thereof, the pull tab has the string-shaped member, and the string-shaped member is attached to the pull tab attachment portion. Accordingly, when the pull tab is attached to the pull tab attachment portion, the string-shaped member of the pull tab can be guided by the wall portions of the right and left first members, thereby allowing the string-shaped member of the pull tab to be easily inserted into the pull tab attachment portion and thus allowing the pull tab to be easily attached to the pull tab attachment portion. Also, because the first members have the wall portions, a strength of the pull tab attachment portion can be improved. Herein, the strength of the pull tab attachment portion means a strength thereof preventing the pull tab attachment portion from being broken due to a tensile strength exerted thereon upon operation of the pull tab or when the slider body formed of metal is subjected to barrel polishing or the like.

EMBODIMENTS OF INVENTION

Hereinafter, each of embodiments of a slide fastener slider according to the present invention will be described in detail on the basis of the accompanying drawings. In the following description, as for the slider, an upper side refers to a near side with respect to the paper surface of FIG. 3, a lower side refers to a far side with respect to the paper surface of FIG. 3, a front side refers to an upper side with respect to the paper surface of FIG. 3, a rear side refers to a lower side with respect to the paper surface of FIG. 3, a right side refers to a right side with respect to the paper surface of FIG. 3, and a left side refers to a left side with respect to of the paper surface of FIG. 3. Also, a right and left direction is referred to as a width direction. More specifically, a side of the slider from which disengaged fastener elements emerge is referred to as the front side and a side from which engaged fastener elements emerge is referred to as the rear side, and therefore a sliding direction of the slider is referred to as a front and rear direction (length direction), a direction perpendicular to the front and rear direction and also parallel to a fastener tape is referred to as the right and left direction (width direction), and a direction perpendicular to the front and rear direction and also the right and left direction is referred to as an upward and downward direction.

First Embodiment

First, a first embodiment of a slide for a fastener slider according to the present invention will be described with reference to FIGS. 1 to 8.

Figure 1:
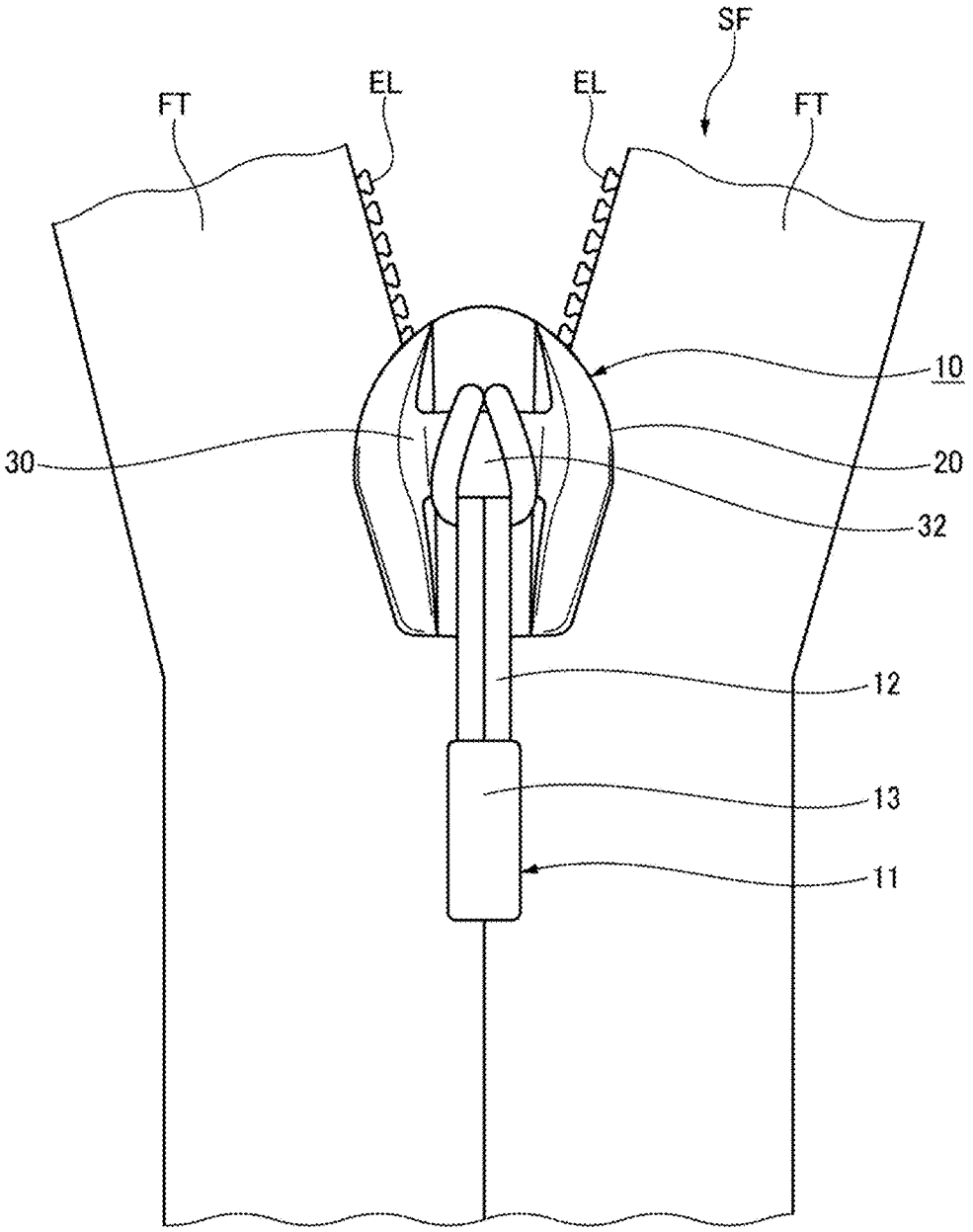
FIG. 1 is a plan view explaining a slide fastener employing a first embodiment of a slider for a slide fastener according to the present invention.

First of all, a slide fastener SF employing a slide fastener slider 10 (hereinafter, simply referred to as "slider") of the present embodiment will be described. As shown in FIG. 1, the slide fastener SF includes a pair of right and left fastener tapes FT, a pair of right and left fastener element rows EL attached on opposing tape side edge portions of the right and left fastener tapes FT, and the slider 10 of the present embodiment for engaging and disengaging the right and left fastener element rows.

The slider 10 of the present embodiment is a free slider, which does not have an automatic stop function, and includes a slider body 20 and a pull tab 11 attached on the slider body 20.

As shown in FIG. 1, the pull tab 11 includes a string-shaped member 12 folded at approximately the middle thereof into a loop shape, and a grip portion 13 formed on both aligned ends of the string-shaped member 12. The string-shaped member 12 of the present embodiment is a round string. The grip portion 13 is formed, for example, by injection-molding of synthetic resin. Alternatively, the grip portion 13 may not be provided, and in this case, both aligned ends of the string-shaped member 12 are bound together.

As shown in FIGS. 2 to 5, the slider body 20 includes an upper blade 21 and a lower blade 22 spaced from each other in the upward and downward direction to be arranged in parallel to each other, a guide post 23 connecting front ends of the upper blade 21 and the lower blade 22, and flanges 24 protruding upward along right and left side edges of the lower blade 22. Thus, right and left shoulder mouths 25 separated by the guide post 23 are formed in a front portion of the slider body 20, and a rear mouth 26 is formed in a rear portion of the slider body 20. Also, between the upper blade 21 and the lower blade 22, an element guide passage 27 having a generally Y-shape is formed to communicate the right and left shoulder mouths 25 with the rear mouth 26, and the element guide passage 27 forms a passage through which fastener element rows, not shown, are allowed to be inserted. Also, the slider body 20 is made of synthetic resin or metal.

Figure 2:
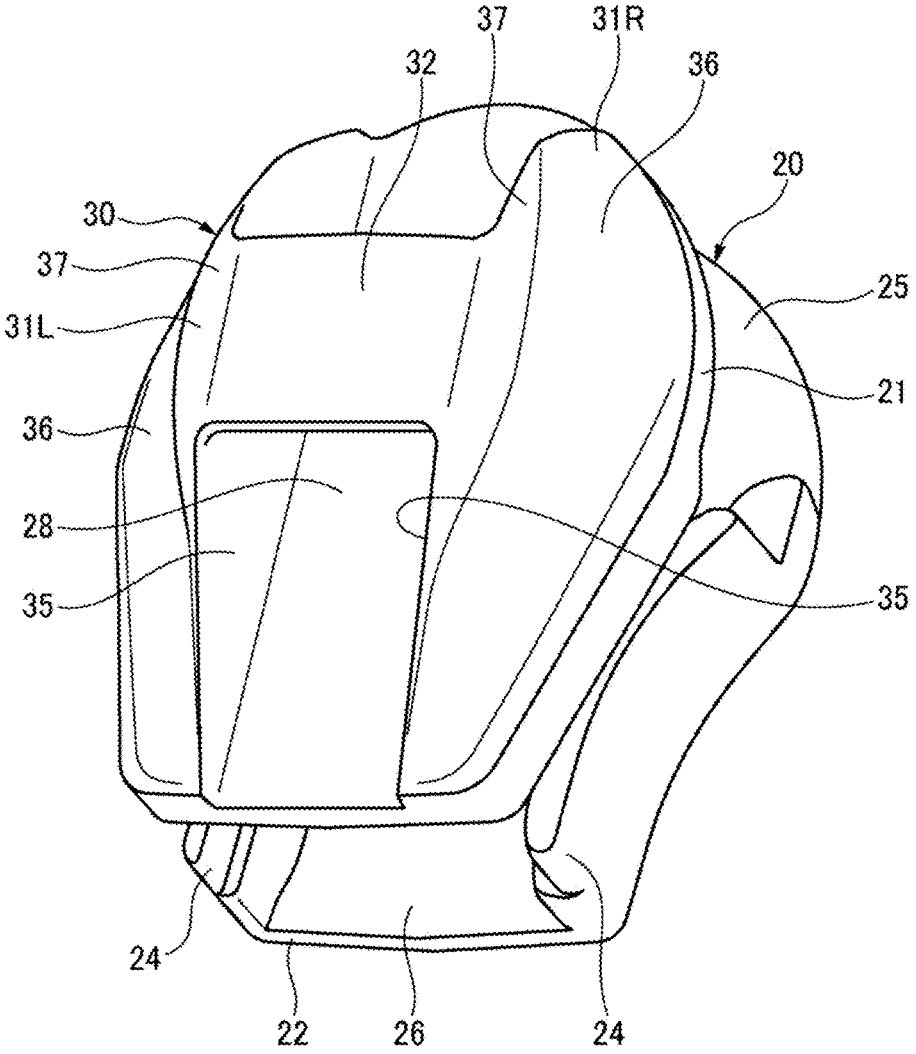
FIG. 2 is a perspective view of the slider shown in FIG. 1.

Further, as shown in FIGS. 1 and 2, a pull tab attachment portion 30 for attaching the pull tab 11 is formed on an upper surface of the upper blade 21 of the slider body 20.

As shown in FIGS. 2 to 5, the pull tab attachment portion 30 has a pair of right and left vertical members (first members) 31L, 31R protruding from the upper surface of the upper blade 21, and a horizontal member (second member) 32 connecting upper end portions of the right and left vertical members 31L, 31R in the right and left direction. Also, a pull tab insertion passage 28 for inserting the string-shaped member 12 of the pull tab 11 therethrough is formed by the upper surface of the upper blade 21 and the right and left vertical members 31L, 31R.

Figure 3:
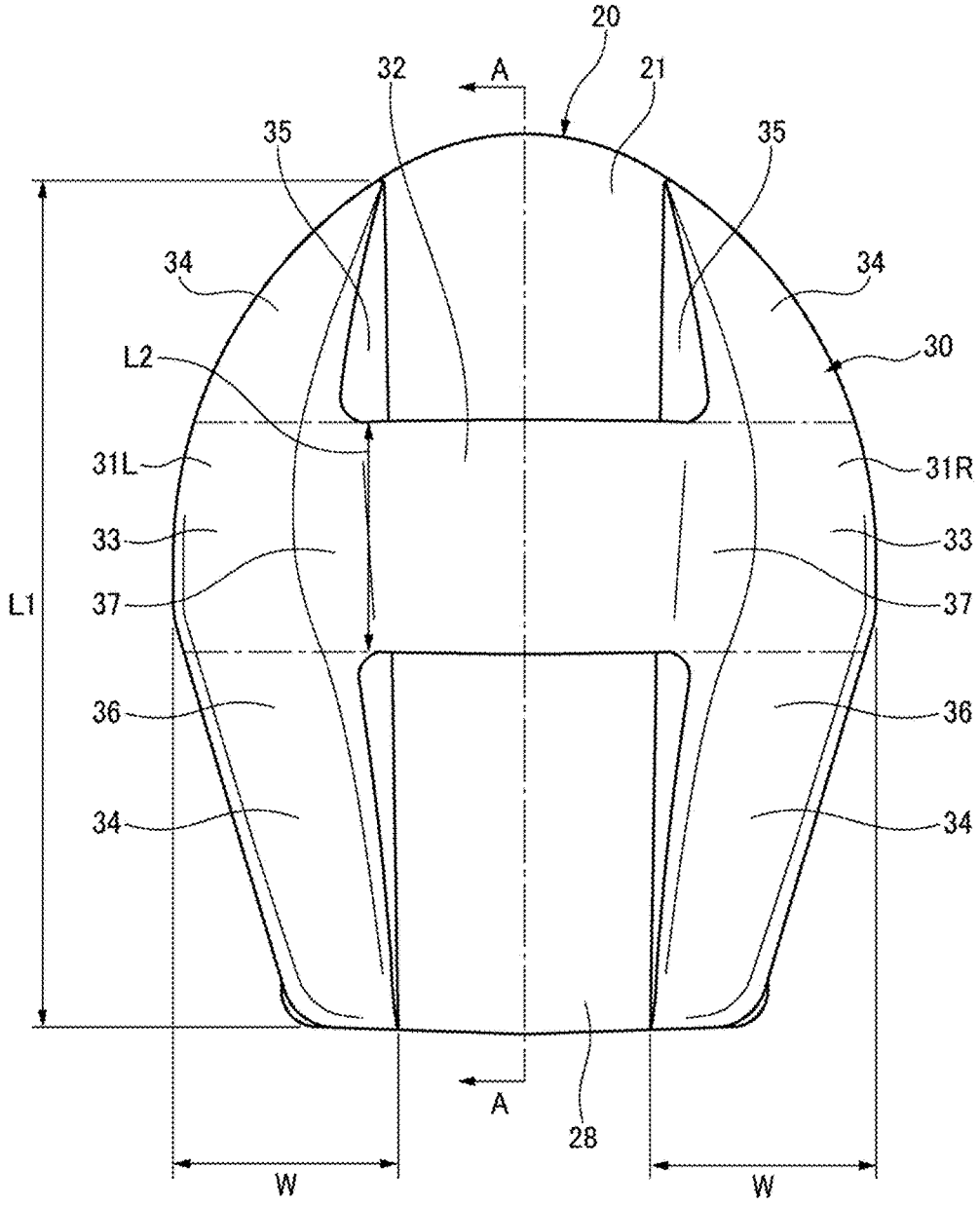
FIG. 3 is a top view of the slider shown in FIG. 2.
Figure 4:
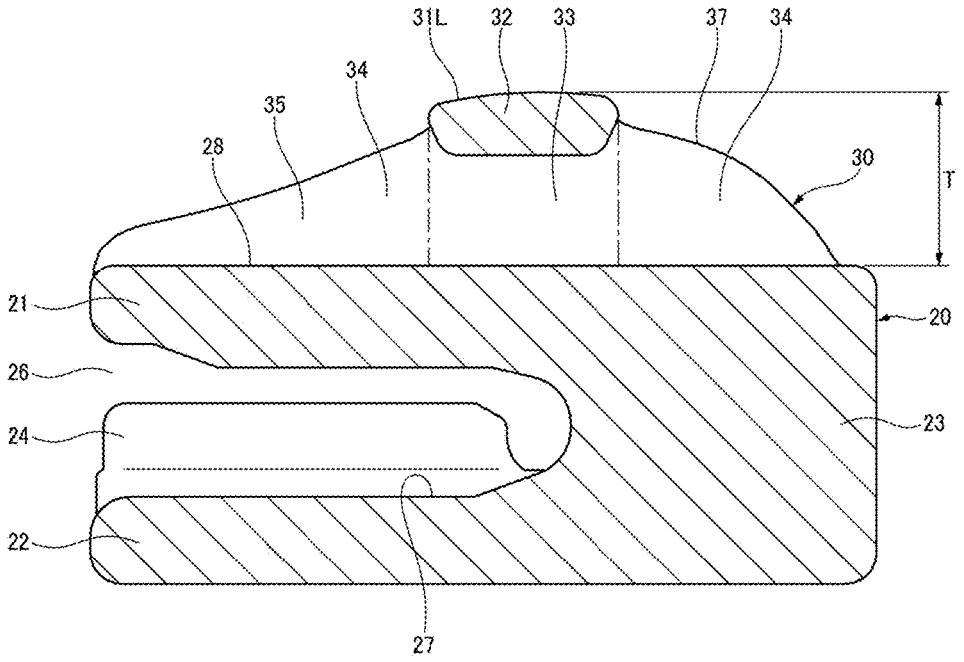
FIG. 4 is a sectional view taken along a line A-A in FIG. 3.

The vertical members 31L, 31R have a base portion 33 connected by the horizontal member 32, and wall portions 34 arranged to extend from the base portion 33 toward both of front and rear sides thereof. Meanwhile, one-dot chain lines in FIGS. 3 and 4 are a boundary line between the base portion 33 and the wall portions 34 on the front side and a boundary line between the base portion 33 and the wall portions 34 on the rear side. In addition, a width L2 of the horizontal member 32 in the front and rear direction is formed to be smaller than a width L1 of the vertical members 31L, 31R in the front and rear direction. Also, the base portion 33 is a portion of the vertical members 31L, 31R, which is arranged to extend in the right and left direction and also the upward and downward direction from a portion, at which the vertical members 31L, 31R are connected to the horizontal member 32, by the same dimensions as the width L2 of the horizontal member 32 in the front and rear direction.

Figure 5:
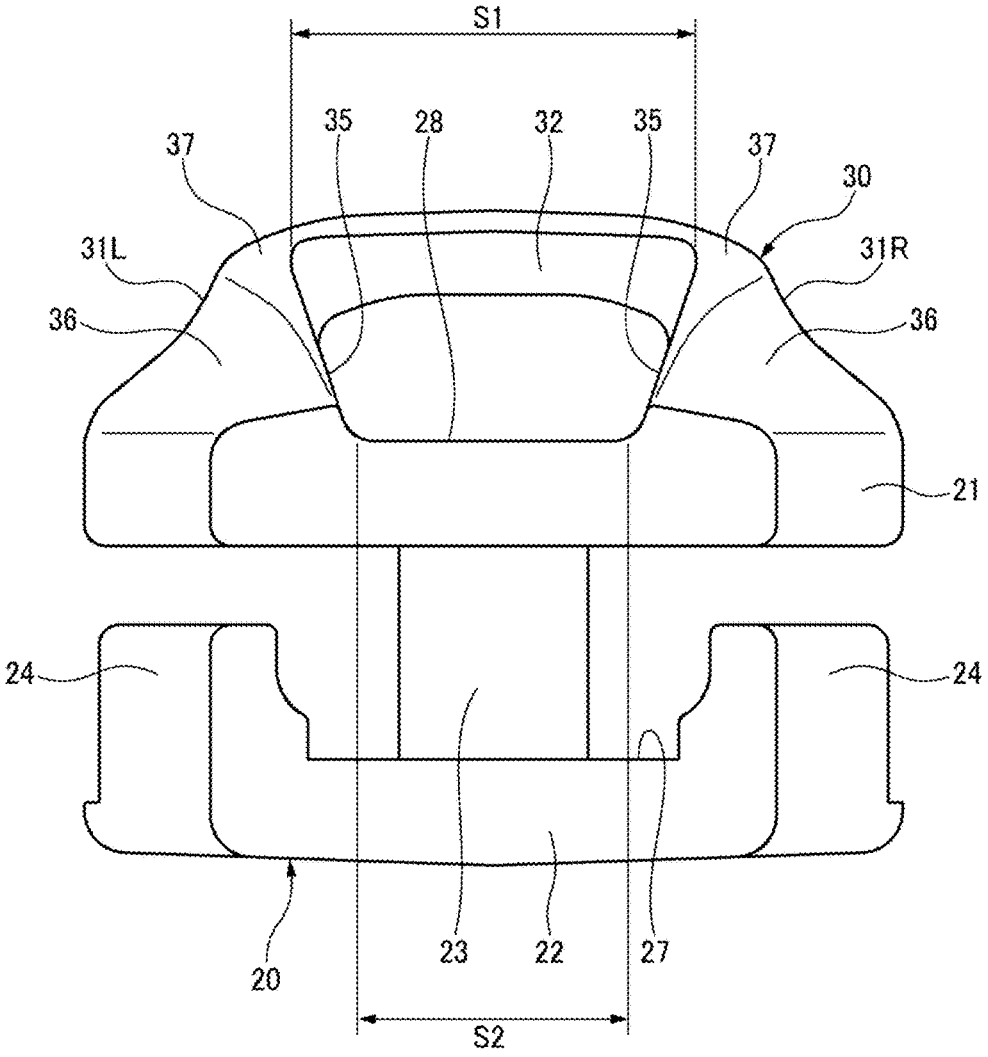
FIG. 5 is a rear view of the slider shown in FIG. 2.

Further, as shown in FIGS. 3 and 5, opposing side surfaces (width-direction inward surfaces) of the right and left vertical members 31L, 31R are respectively formed as inclined surfaces 35, and a space S1 between upper end portions of the right and left inclined surfaces 35 is set to be greater than a space S2 between lower end portions of the right and left inclined surfaces 35. Also, width-direction outward surfaces of the right and left vertical members 31L, 31R are respectively formed as concavely curved surfaces 36, which are recessed inward in the right and left direction.

Also, as shown in FIG. 4, an upper surface 37 of the right and left vertical members 31L, 31R is formed so that a width T of the vertical members 31L, 31R in the upward and downward direction gradually decreases toward the front and rear end sides thereof.

Also, as shown in FIGS. 3 and 4, the horizontal member 32 is arranged at a location, at which a width W of the vertical members 31L, 31R in the right and left direction is the largest, and also at a location, at which the width T of the vertical members 31L, 31R in the upward and downward direction is the largest. In addition, the horizontal member 32 is formed in such an arch shape so that a width thereof in the upward and downward direction at the middle in the right and left direction is the highest.

Further, the pull tab 11 is attached to the horizontal member 32, by inserting a folded portion of the string-shaped member 12 into the pull tab insertion passage 28 from the rear side, withdrawing the folded portion of the string-shaped member 12 rearward relative to the horizontal member 32 while passing above the horizontal member 32, and then inserting the grip portion 13 of the pull tab 11 through the withdrawn folded portion.

As described above, according to the slide fastener slider 10 of the present embodiment, the pull tab attachment portion 30 has the pair of right and left vertical members 31L, 31R protruding from the upper surface of the upper blade 21 and the horizontal member 32 connecting upper end portions of the pair of the right and left vertical members 31L, 31R in the right and left direction, the vertical members 31L, 31R have the base portion 33 connected by the horizontal member 32 and the wall portions 34 arranged to extend from the base portion 33 toward both of the front and rear sides thereof, and the string-shaped member 12 of the pull tab 11 is attached to the horizontal member 32. Accordingly, when the pull tab 11 is attached to the horizontal member 32, the string-shaped member 12 of the pull tab 11 can be guided by the wall portions 34 of the right and left vertical members 31L, 31R, thereby allowing the string-shaped member 12 of the pull tab 11 to be easily inserted into the pull tab attachment portion 30 and thus allowing the pull tab 11 to be easily attached to the pull tab attachment portion 30. Also, because the vertical members 31L, 31R have the wall portions 34, a strength of the pull tab attachment portion 30 can be improved.

Also, according to the slide fastener slider 10 of the present embodiment, the vertical members 31L, 31R have the wall portions 34 extending toward both of the front and rear sides. Accordingly, when the pull tab 11 is attached to the horizontal member 32, the string-shaped member 12 of the pull tab 11 can be guided by the wall portions 34 even if inserted from either of the front or rear side. Therefore, the string-shaped member 12 of the pull tab 11 can be further easily inserted into the pull tab attachment portion 30 and thus the pull tab 11 can be further easily attached to the pull tab attachment portion 30.

Also, according to the slide fastener slider 10 of the present embodiment, opposing side surfaces of the right and left vertical members 31L, 31R are respectively formed as inclined surfaces 35, and the space S1 between upper end portions of the right and left inclined surfaces is set to be greater than the space S2 between lower end portions of the right and left inclined surfaces 35. Accordingly, an upper end side of the right and left vertical members 31L, 31R is formed to be wider than a lower end side thereof. Therefore, the string-shaped member 12 of the pull tab 11 can be guided by the inclined surfaces 35, thereby allowing the string-shaped member 12 of the pull tab 11 to be further easily inserted into the pull tab attachment portion 30 and thus allowing the pull tab 11 to be further easily attached to the pull tab attachment portion 30.

Also, according to the slide fastener slider 10 of the present embodiment, the horizontal member 32 is arranged at a location, at which the width W of the vertical members 31L, 31R in the right and left direction is the largest, thereby further improving the strength of the pull tab attachment portion 30.

Further, according to the slide fastener slider 10 of the present embodiment, the upper surface 37 of the vertical members 31L, 31R is formed so that the width T of the vertical members 31L, 31R in the upward and downward direction gradually decreases toward the front and rear end sides thereof, thereby improving feeling and designability of the slider 10. In addition, because the horizontal member 32 is arranged at a location, at which the width T of the vertical members 31L, 31R in the upward and downward direction is the largest, a large space can be provided between the horizontal member 32 and the upper blade 21. Therefore, the string-shaped member 12 of the pull tab 11 can be further easily inserted into the pull tab attachment portion 30 and thus the pull tab 11 can be further easily attached to the pull tab attachment portion 30. Also, by arranging the horizontal member 32 at the location, at which the width T of the vertical members 31L, 31R in the upward and downward direction is the largest, a degree of freedom in design of a thickness of the horizontal member 32 in the upward and downward direction can be improved. In addition, if the thickness of the horizontal member 32 is increased, the strength of the pull tab attachment portion 30 can be improved.

Figure 6:
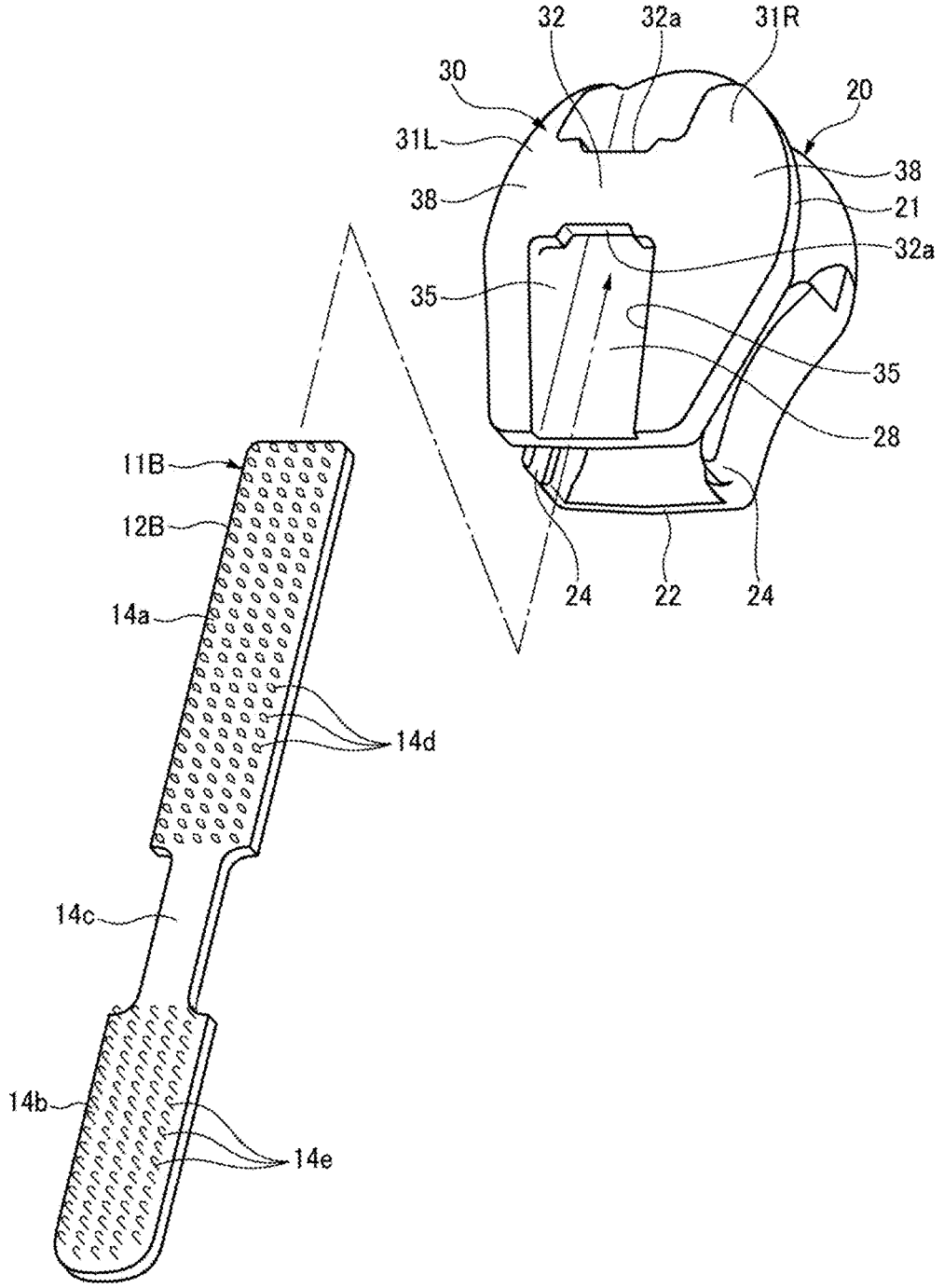
FIG. 6 is a perspective view explaining a second embodiment of a slide fastener slider according to the present invention.
Figure 7:
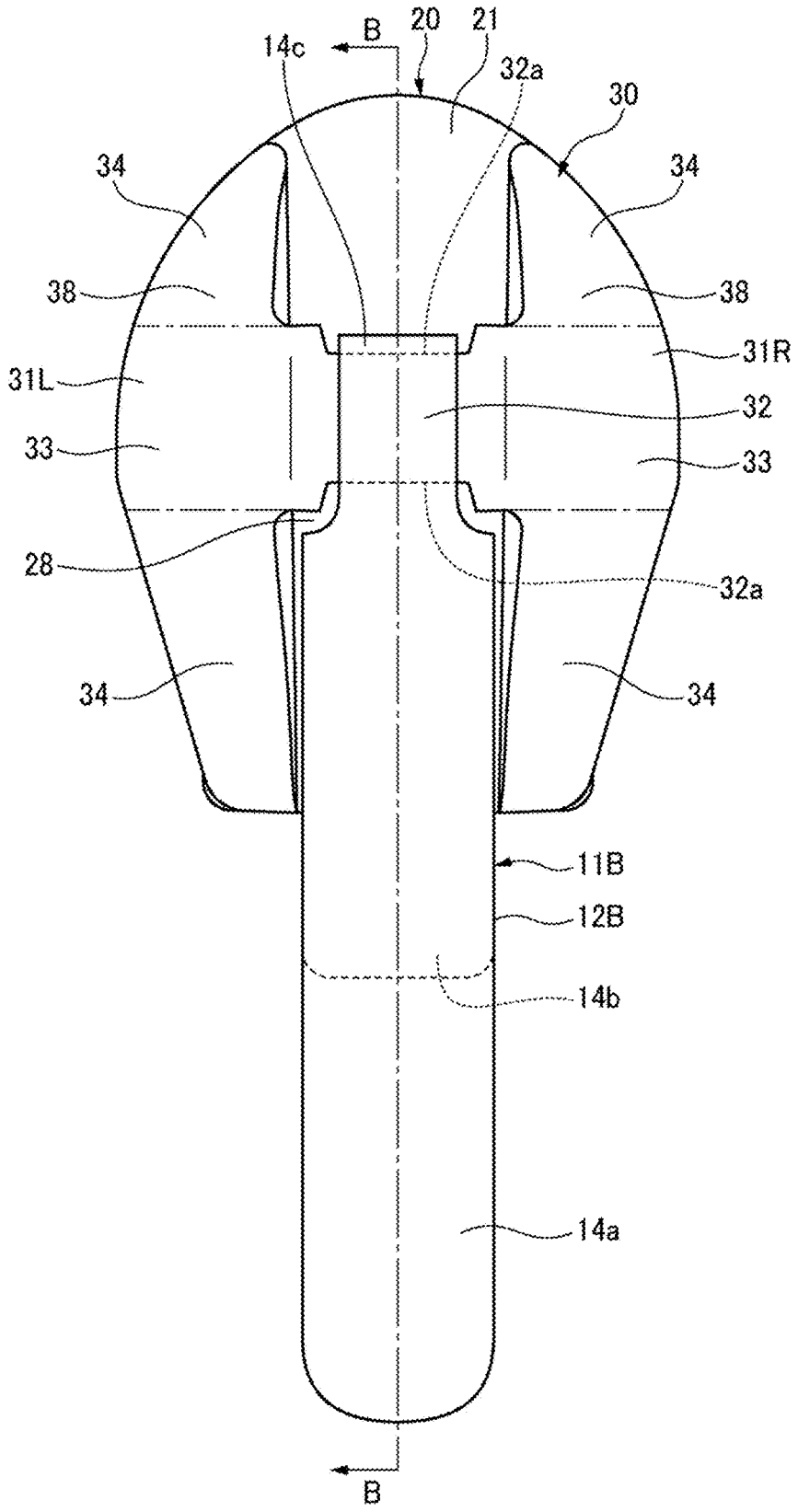
FIG. 7 is a top view of the slider shown in FIG. 6.
Figure 8:
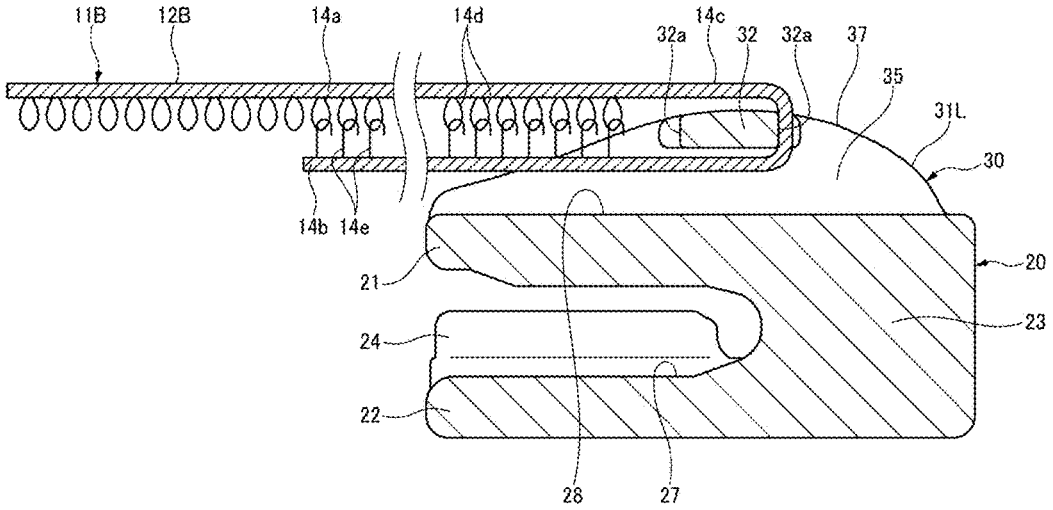
FIG. 8 is a sectional view taken along a line B-B in FIG. 7.

Next, as a variant of the present embodiment, a pull tab 11B as shown in FIGS. 6 to 8 may be employed instead of the pull tab 11. The pull tab 11B has a band-shaped member 12B as the string-shaped member. The band-shaped member 12B, which is a band-shaped foldable woven body, has a first band portion 14*a* as a grip portion arranged in the front and rear direction of the slider, a second band portion 14*b* having a length in the front and rear direction shorter than that of the first band portion 14*a*, and a folded portion 14*c* connecting the first and second band portions 14*a* and 14*b* and having a width narrower than those of the first and second band portions 14*a*, 14*b*.

Also, a plurality of loops 14*d* are formed on one surface of the first band portion 14*a* and a plurality of hooks 14*e* capable of being engaged with or disengaged from the plurality of loops 14*d* of the first band portion 14*a* are formed on one surface of the second band portion 14*b*, and thus the first and second band portions 14*a*, 14*b* constitute a touch fastener. Alternatively, the plurality of hooks 14*e* may be formed on the first band portion 14*a* and the plurality of loops 14*d* may be formed on the second band portion 14*b*. In order to improve feeling of the grip portion when gripped with finger tips or the like, a portion of the first band portion 14*a*, which becomes the grip portion, is preferably not provided with loops 14*d*.

Further, the pull tab 11B is attached to the horizontal member 32 by inserting the first band portion 14*a* into the pull tab insertion passage 28 from the rear side, folding the first band portion 14*a* rearward to pass above the horizontal member 32, and then engaging the loops 14*d* of the first band portion 14*a* with the hooks 14*e* of the second band portion 14*b*.

Also, in the present variant, as shown in FIGS. 6 to 8, recess portions 32*a* are respectively formed on front and rear surfaces of the horizontal member 32 of the pull tab attachment portion 30. Therefore, the pull tab 11B attached to the horizontal member 32 can be fitted into the recess portion 32*a*, thereby positioning the pull tab 11B at the middle in the right and left direction. Further, in the present variant, width-direction outward surfaces of right and left vertical members 31L, 31R are formed as convexly curved surfaces 38, which protrude outward in the right and left direction.

Second Embodiment

Next, a second embodiment of a pull tab of a slide for a fastener slider according to the present invention will be described with reference to FIGS. 9 to 12. Meanwhile, the same or equivalent parts as those of the first embodiment will be designated by the same or equivalent reference numerals in the figures, and accordingly the description thereof will be omitted or simplified.

Figure 9:
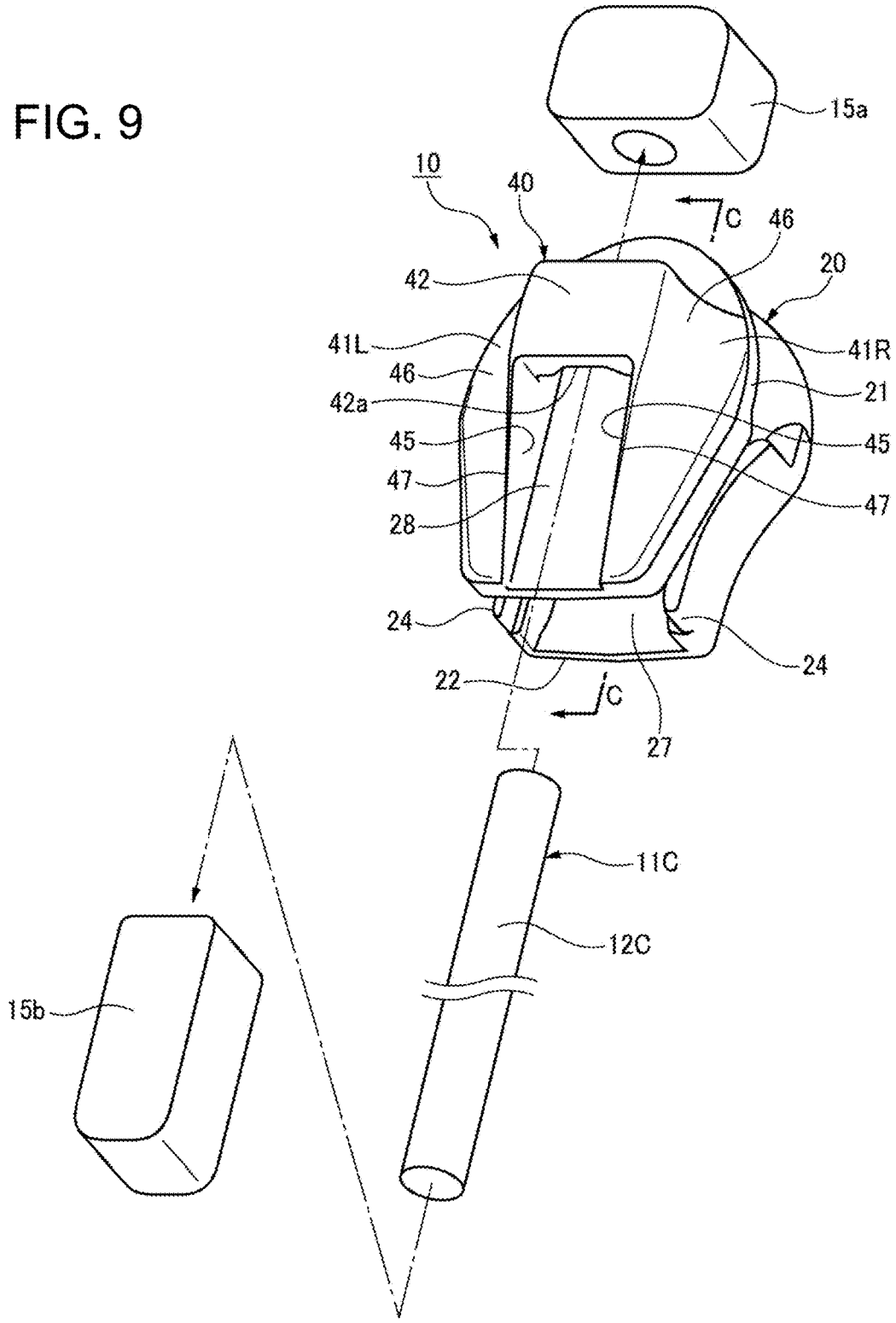
FIG. 9 is a perspective view explaining a third embodiment of a slide fastener slider according to the present invention.
Figure 10:
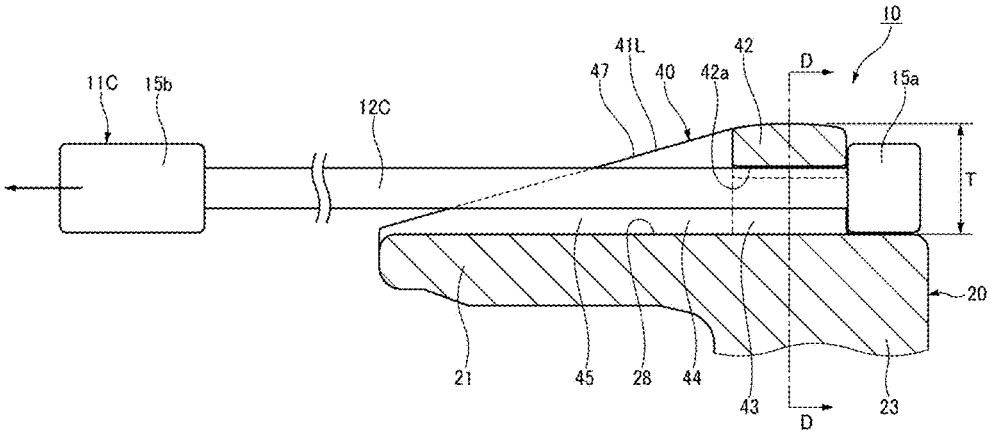
FIG. 10 is a sectional view taken along a line C-C in FIG. 9.

In the present embodiment, as shown in FIGS. 9 and 10, instead of the pull tab attachment portion 30, a pull tab attachment portion 40 is formed on an upper surface of an upper blade 21 of a slider body 20, and a pull tab 11C is attached to the pull tab attachment portion 40.

As shown in FIGS. 9 to 12, the pull tab attachment portion 40 has a pair of right and left vertical members (first members) 41L, 41R protruding from the upper surface of the upper blade 21, and a horizontal member (second member) 42 connecting upper end portions of the right and left vertical members 41L, 41R in the right and left direction. Also, a pull tab insertion passage 28 for inserting a string-shaped member 12 of a pull tab 11 therethrough is formed by the upper surface of the upper blade 21 and the right and left vertical members 41L, 41R.

The vertical members 41L, 41R have a base portion 43 connected by the horizontal member 42, and a wall portion 44 arranged to extend from the base portion 43 toward the rear side thereof. Also, front end surfaces of the vertical members 41L, 41R are flushed with a front end surface of the horizontal member 42. In addition, the base portion 43 of the present embodiment is arranged on a more front side of the slider than the base portion 33 of the first embodiment as described above. Meanwhile, a one-dot chain line in FIG. 10 is a boundary line between the base portion 43 and the wall portions 44.

Figure 11:
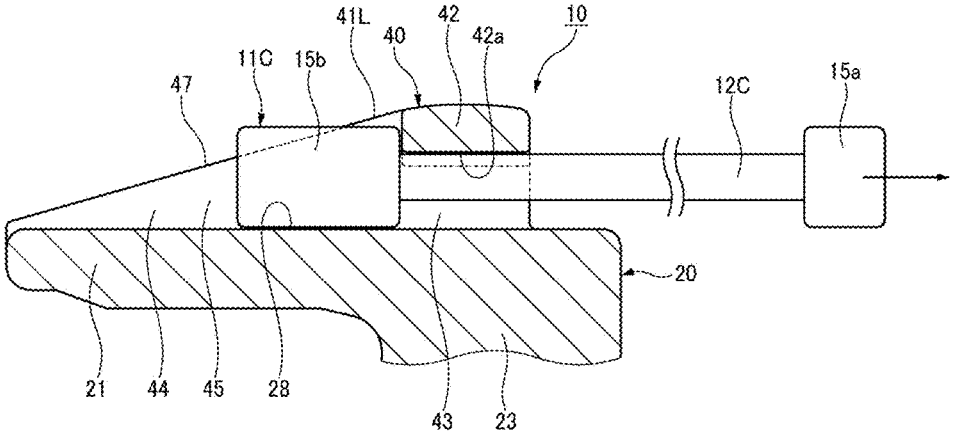
FIG. 11 is a sectional view corresponding to FIG. 10, but illustrating a state where a pull tab shown in FIG. 10 is moved to the front side.

As shown in FIGS. 9 to 11, the pull tab 11C includes a string-shaped member 12C configured to be inserted into a pull tab insertion passage 28 of the pull tab attachment portion 40, a first pull tab main body 15*a* attached on a front end portion of the string-shaped member 12C, and a second pull tab main body 15*b* attached on a rear end portion of the string-shaped member 12C. The first and second pull tab main bodies 15*a*, 15*b* are made of synthetic resin and are attached on the string-shaped member 12C by adhesive, welding, injection-molding or the like.

The first pull tab main body 15*a* has a generally rectangular shape and as shown in FIG. 10, is configured to be abutted against the front end surfaces of the vertical members 41L, 41 and the front end surface of the horizontal member 42 when the pull tab 11C is pulled rearward, thereby preventing the pull tab 11C from being fallen out of the pull tab attachment portion 40.

The second pull tab main body 15*b* has a generally rectangular shape and as shown in FIG. 11, is configured to be abutted against a rear end surface of the horizontal member 42 when the pull tab 11C is pulled forward, thereby preventing the pull tab 11C from being fallen out of the pull tab attachment portion 40. In addition, the second pull tab main body 15*b* is formed to be fitted between the wall portions 44 of the right and left vertical members 41L, 41R when the pull tab 11C is pulled forward.

Also, as shown in FIGS. 9 to 12, a recess portion 42*a* is formed in a lower surface of the horizontal member 42 of the pull tab attachment portion 40. Therefore, the string-shaped member 12C of the pull tab 11C inserted in the pull tab attachment portion 40 can be fitted in the recess portion 42*a*, thereby positioning the string-shaped member 12C at the middle in the right and left direction and also allowing forward and rearward movements of the pull tab 11C to be guided.

Figure 12:
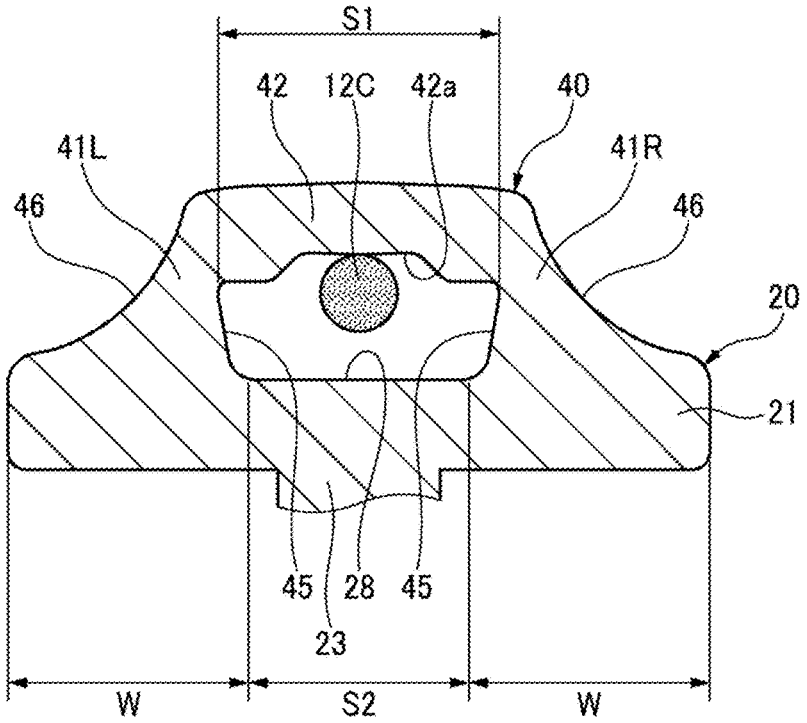
FIG. 12 is a sectional view taken along a line D-D in FIG. 10.

Also, as shown in FIG. 12, opposing side surfaces (width-direction inward surfaces) of the right and left vertical members 41L, 41R are respectively formed as inclined surfaces 45, and a space S1 between upper end portions of the right and left inclined surfaces 45 is set to be greater than a space S2 between lower end portions of the right and left inclined surfaces 45. Also, width-direction outward surfaces of the right and left vertical members 41L, 41R are respectively formed as concavely curved surfaces 46, which are recessed inward in the right and left direction.

Also, as shown in FIGS. 9 and 10, an upper surface 47 of the right and left vertical members 41L, 41R is formed so that a width Tin the upward and downward direction of the vertical members 41L, 41R gradually decreases toward the rear end side thereof.

Also, as shown in FIGS. 10 and 12, the horizontal member 42 is arranged at a location, at which a width W of the vertical members 41L, 41R in the right and left direction is the largest, and also at a location, at which the width T of the vertical members 41L, 41R in the upward and downward direction is the largest. In addition, the horizontal member 42 is formed in such an arch shape so that a width thereof in the upward and downward direction at the middle in the right and left direction is the highest.

As described above, according to the slide fastener slider 10 of the present embodiment, the pull tab attachment portion 40 has the pair of right and left vertical members 41L, 41R protruding from the upper surface of the upper blade 21 and the horizontal member 42 connecting upper end portions the pair of the right and left vertical members 41L, 41R in the right and left direction, the vertical members 41L, 41R have the base portion 43 connected by the horizontal member 42 and the wall portion 44 arranged to extend from the base portion 43 toward the rear side thereof, and the string-shaped member 12C of the pull tab 11C is attached to the horizontal member 42. Accordingly, when the string-shaped member 12C of the pull tab 11 is inserted into the pull tab attachment portion 40, the string-shaped member 12C can be guided by the wall portions 44 of the right and left vertical members 41L, 41R, thereby allowing the string-shaped member 12C of the pull tab 11C to be easily inserted into the pull tab attachment portion 40 and thus allowing the pull tab 11C to be easily attached to the pull tab attachment portion 40. Also, because the vertical members 41L, 41R have the wall portions 44, a strength of the pull tab attachment portion 40 can be improved.

Also, according to the slide fastener slider 10 of the present embodiment, opposing side surfaces of the right and left vertical members 41L, 41R are respectively formed as inclined surfaces 45, and the space S1 between upper end portions of the right and left inclined surfaces 45 is set to be greater than the space S2 between lower end portions of the right and left inclined surfaces 45. Accordingly, an upper end side of the right and left vertical members 41L, 41R is formed to be wider than a lower end side thereof. Therefore, the string-shaped member 12C of the pull tab 11C can be guided by the inclined surfaces 45, thereby allowing the string-shaped member 12C of the pull tab 11C to be further easily inserted into the pull tab attachment portion 40 and thus allowing the pull tab 11C to be further easily attached to the pull tab attachment portion 40.

Also, according to the slide fastener slider 10 of the present embodiment, the horizontal member 42 is arranged at a location, at which the width W of the vertical members 41L, 41R in the right and left direction is the largest, thereby further improving the strength of the pull tab attachment portion 40.

Further, according to the slide fastener slider 10 of the present embodiment, the upper surface 47 of the vertical members 41L, 41R is formed so that the width T of the vertical members 41L, 41R in the upward and downward direction gradually decreases toward the rear end side thereof, thereby improving feeling and designability of the slider 10. In addition, because the horizontal member 42 is arranged at a location, at which the width T of the vertical members 41L, 41R in the upward and downward direction is the largest, a large space can be provided between the horizontal member 42 and the upper blade 21. Therefore, the string-shaped member 12C of the pull tab 11C can be further easily inserted into the pull tab attachment portion 40 and thus the pull tab 11C can be further easily attached to the pull tab attachment portion 40. Also, by arranging the horizontal member 42 at the location, at which the width T of the vertical members 41L, 41R in the upward and downward direction is the largest, a degree of freedom in design of a thickness of the horizontal member 42 in the upward and downward direction can be improved. In addition, if the thickness of the horizontal member 42 is increased, the strength of the pull tab attachment portion 40 can be improved.

The other configurations and effects are the same as those of the first embodiment.

Third Embodiment

Next, a third embodiment of a pull tab of a slide for a fastener slider according to the present invention will be described with reference to FIGS. 13 to 15. Meanwhile, the same or equivalent parts as those of the first embodiment will be designated by the same or equivalent reference numerals in the figures, and accordingly the description thereof will be omitted or simplified.

Figure 13:
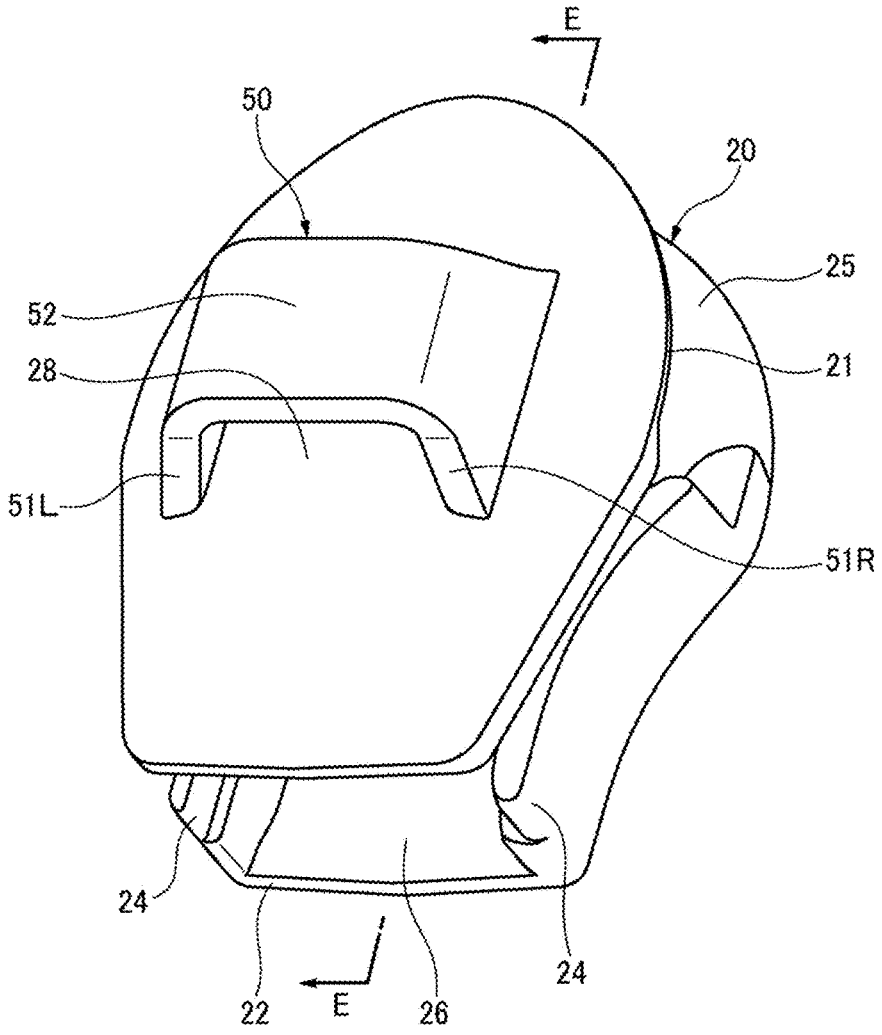
FIG. 13 is a perspective view explaining a fourth embodiment of a slide fastener slider according to the present invention.
Figure 14:
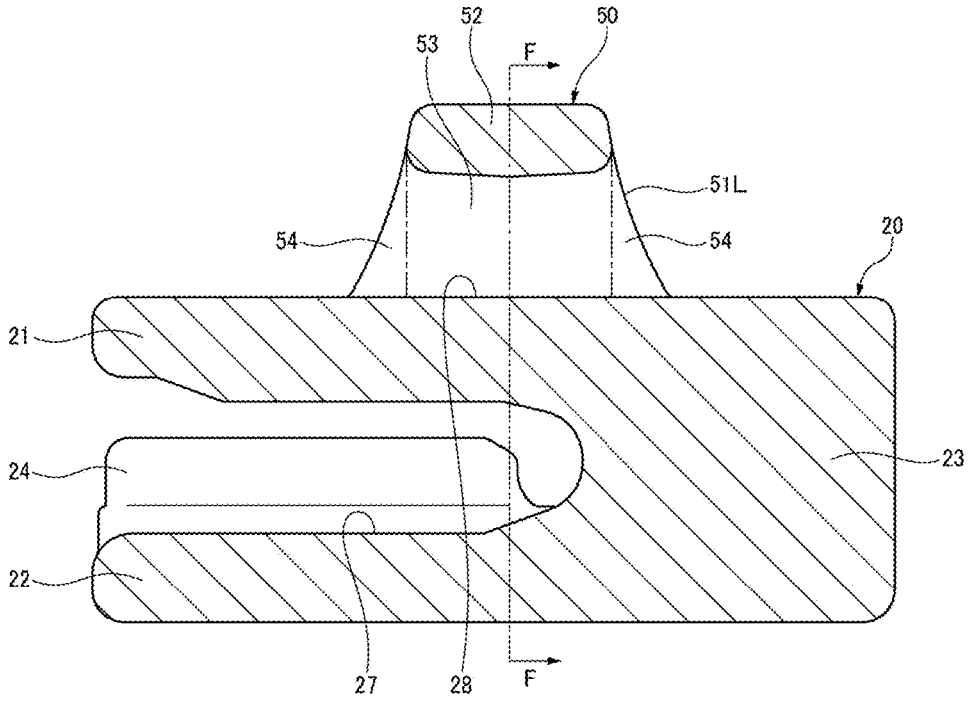
FIG. 14 is a sectional view taken along a line E-E in FIG. 13.

In the present embodiment, as shown in FIGS. 13 and 14, instead of the pull tab attachment portion 30, a pull tab attachment portion 50 is formed on an upper surface of an upper blade 21 of a slider body 20. Also, in the present embedment, it is assumed that, for example, the pull tab 11 shown in FIG. 1 is attached to the pull tab attachment portion 50.

Figure 15:
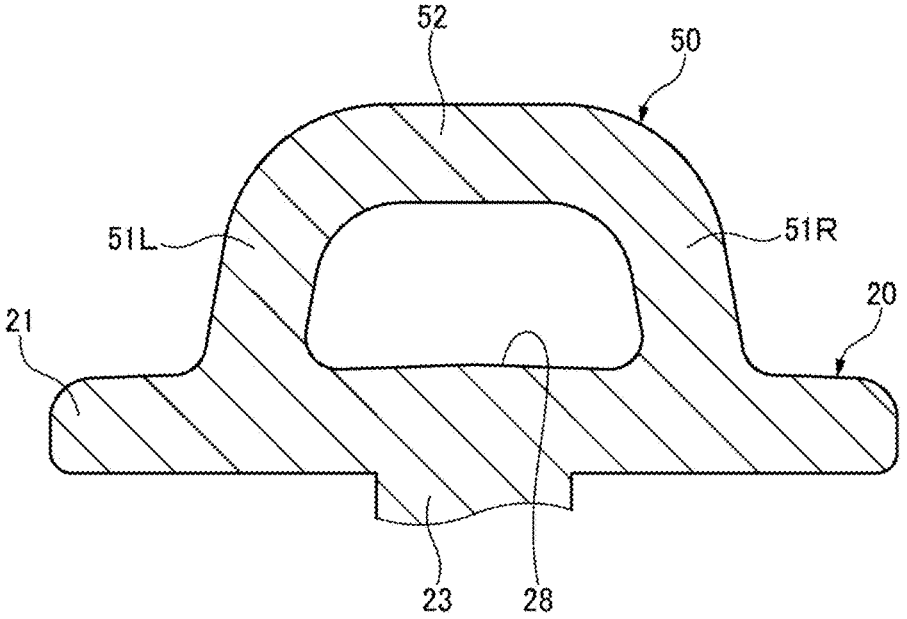
FIG. 15 is a sectional view taken along a line F-F in FIG. 14.

As shown in FIGS. 13 to 15, the pull tab attachment portion 50 has a pair of right and left vertical members (first members) 51L, 51R protruding from the upper surface of the upper blade 21, and a horizontal member (second member) 52 connecting upper end portions of the right and left vertical members 51L, 51R in the right and left direction. Also, a pull tab insertion passage 28 for inserting a string-shaped member 12 of a pull tab 11 therethrough is formed by the upper surface of the upper blade 21 and the right and left vertical members 51L, 51R.

The vertical members 51L, 51R have a base portion 53 connected by the horizontal member 52, and wall portions 54 arranged to extend from the base portion 53 toward both of front and rear sides thereof. Meanwhile, one-dot chain lines in FIG. 14 are a boundary line between the base portion 53 and the wall portions 54 on the front side and a boundary line between the base portion 53 and the wall portions 54 on the rear side.

As described above, according to the slide fastener slider 10 of the present embodiment, the pull tab attachment portion 50 has the pair of right and left vertical members 51L, 51R protruding from the upper surface of the upper blade 21 and the horizontal member 52 connecting upper end portions of the pair of the right and left vertical members 51L, 51R in the right and left direction, the vertical members 51L, 51R have the base portion 53 connected by the horizontal member 52 and the wall portions 54 arranged to extend from the base portion 53 toward both of the front and rear sides thereof, and the string-shaped member 12 of the pull tab 11 is attached to the horizontal member 52. Accordingly, when the pull tab 11 is attached to the horizontal member 52, the string-shaped member 12 of the pull tab 11 can be guided by the wall portions 54 of the right and left vertical members 51L, 51R, thereby allowing the string-shaped member 12 of the pull tab 11 to be easily inserted into the pull tab attachment portion 50 and thus allowing the pull tab 11 to be easily attached to the pull tab attachment portion 50. Also, because the vertical members 51L, 51R have the wall portions 54, a strength of the pull tab attachment portion 50 can be improved.

Also, according to the slide fastener slider 10 of the present embodiment, the vertical members 51L, 51R have the wall portions 54 extending toward both of the front and rear sides thereof. Accordingly, when the pull tab 11 is attached to the horizontal member 52, the string-shaped member 12 of the pull tab 11 can be guided by the wall portion 54 even if inserted from either of the front or rear side. Therefore, the string-shaped member 12 of the pull tab 11 can be further easily inserted into the pull tab attachment portion 50 and thus the pull tab 11 can be further easily attached to the pull tab attachment portion 50.

The other configurations and effects are the same as those of the first embodiment.

Meanwhile, the present invention is not limited to configurations as illustrated in each of the foregoing embodiments, and accordingly, appropriate modifications thereof may be made without departing from the spirit and scope of the invention.

DESCRIPTION OF REFERENCE NUMERALS

10 Slide Fastener Slider
11 Pull Tab
11B Pull Tab
11C Pull Tab
12 String-Shaped Member
12B Band-Shaped Member (String-Shaped Member)
12C String-Shaped Member
20 Slider Body
21 Upper Blade
22 Lower Blade
23 Guide Post
28 Pull Tab Insertion Passage
30 Pull Tab Attachment Portion
31L Vertical Member (First Member)
31R Vertical Member (First Member)
32 Horizontal Member (Second Member)
32*a* Recess Portion
33 Base Portion
34 Wall Portion
35 Inclined Surface

37 Upper Surface
40 Pull Tab Attachment Portion
41L Vertical Member (First Member)
41R Vertical Member (First Member)
42 Horizontal Member (Second Member)
42*a* Recess Portion
43 Base Portion
44 Wall Portion
45 Inclined Surface
47 Upper Surface
50 Pull Tab Attachment Portion
51L Vertical Member (First Member)
51R Vertical Member (First Member)
52 Horizontal Member (Second Member)
53 Base Portion
54 Wall Portion

The invention claimed is:

1. A slide fastener slider, configured to move in a front-rear direction, and comprising a slider body having an upper blade and a lower blade connected by a guide post at front end sides thereof, and a pull tab attached to a pull tab attachment portion formed on the upper blade, wherein the pull tab attachment portion has a pair of right and left first members protruding from the upper surface of the upper blade, and a second member connecting the pair of the right and left first members, so as to form an insertion passage opening in the front-rear direction, wherein the first members have a base portion and a wall portion arranged to extend from the base portion toward at least one of front and rear sides thereof, wherein the pull tab has a string-shaped member and the string-shaped member is inserted into the insertion passage in the front-rear direction and attached to the pull tab attachment portion, and wherein the wall portions are arranged to extend toward the front sides beyond a front end of the second member or arranged to extend toward the rear sides beyond a rear end of the second member.

2. The slide fastener slider according to claim 1, wherein the wall portions are arranged to extend from the base portion toward both of the front and rear sides.

3. The slide fastener slider according to claim 1, wherein the second member is arranged at a location, at which a width of the first members in a right and left direction is the largest.

4. The slide fastener slider according to claim 1, wherein a recess portion is formed in the second member.

5. A slide fastener slider comprising a slider body having an upper blade and a lower blade connected by a guide post at front end sides thereof, and a pull tab attached to a pull tab attachment portion formed on the upper blade, wherein the pull tab attachment portion has a pair of right and left first members protruding from the upper surface of the upper blade, and a second member connecting the pair of the right and left first members, wherein the first members have a base portion and a wall portion arranged to extend from the base portion toward at least one of front and rear sides thereof, wherein the pull tab has a string-shaped member and the string-shaped member is attached to the pull tab attachment portion, wherein opposing side surfaces of the pair of the right and left first members are respectively formed as inclined surfaces, and wherein a space between upper end portions of the right and left inclined surfaces is set to be greater than a space between lower end portions of the right and left inclined surfaces.

6. A slide fastener slider comprising a slider body having an upper blade and a lower blade connected by a guide post at front end sides thereof, and a pull tab attached to a pull tab attachment portion formed on the upper blade, wherein the pull tab attachment portion has a pair of right and left first members protruding from the upper surface of the upper blade, and a second member connecting the pair of the right and left first members, wherein the first members have a base portion and a wall portion arranged to extend from the base portion toward both of front and rear sides thereof, and wherein the pull tab has a string-shaped member and the string-shaped member is attached to the pull tab attachment portion, wherein an upper surface of the first members is formed so that a width of the first members in an upward and downward direction gradually decreases toward front and rear end sides thereof, and wherein the second member is arranged at a location, at which the width of the first members in the upward and downward direction is the largest.

* * * * *